United States Patent [19]

Ishida et al.

[11] 4,119,573

[45] Oct. 10, 1978

[54] GLAZE RESISTOR COMPOSITION AND METHOD OF MAKING THE SAME

[75] Inventors: Toru Ishida; Masumi Hattori, both of Hirakata; Shinichi Tanaka; Tomi Sato, both of Neyagawa; Kenji Kuwahara, Kobe, all of Japan

[73] Assignee: Matsushita Electric Industrial Co., Ltd., Japan

[21] Appl. No.: 846,496

[22] Filed: Oct. 27, 1977

[30] Foreign Application Priority Data

Nov. 10, 1976 [JP] Japan ..... 51/136088
Nov. 10, 1976 [JP] Japan ..... 51/136089

[51] Int. Cl.[2] ..... H01B 1/00; H01C 7/02; H01C 7/04

[52] U.S. Cl. ..... 252/519; 106/47 R; 106/48; 106/54; 106/73.4; 106/73.5; 252/521

[58] Field of Search ..... 106/54, 48, 73.5; 252/521, 519

[56] References Cited

U.S. PATENT DOCUMENTS 3,027,332 3/1962 Medin ..... 252/520
3,119,717 1/1964 Veres ..... 252/521

FOREIGN PATENT DOCUMENTS 2,600,912 7/1976 Fed. Rep. of Germany ..... 252/519
49-31,524 8/1974 Japan ..... 106/54

*Primary Examiner*—Helen McCarthy
*Attorney, Agent, or Firm*—Wenderoth, Lind & Ponack

[57] ABSTRACT

A glaze resistor composition composed of magnesium silicide, molybdenum disilicide, tantalum disilicide and glass frit, and if necessary, manganese disilicide and/or aluminum oxide. Due to the use of magnesium silicide, glaze resistors having stable resistivities in a wide resistivity range can be obtained. Due to the use of manganese disilicide, the temperature coefficient of resistivity can be shifted to the positive side, and due to the use of aluminum oxide, the resistivity can be increased and made more stable. This invention also provides a method of making a glaze resistor using two heating steps, in which aluminum oxide is mixed in the starting powder mixture to be subjected to the first heating step, so as to enhance the effect of the aluminum oxide addition.

18 Claims, 3 Drawing Figures

GLAZE RESISTOR COMPOSITION AND METHOD OF MAKING THE SAME

This invention relates to a glaze resistor composition using silicides and method of making the same.

British Pat. No. 1,263,728 teaches a glaze resistor composition using molybdenum disilicide, molybdenum boride and tungsten disilicide. U.S. Pat. No. 3,027,332 teaches a body type heat resistant material using molybdenum disilicide, tantalum disilicide and a glass frit having aluminum oxide contained therein. A composition comprising molybdenum disilicide, tantalum disilicide and a glass frit coated on a heat resistant substrate can be fired in air to become a glaze resistor in some resistivity range. However, a high resistivity glaze resistor which has a stable resistivity and which has a small temperature coefficient of resistivity and produces only low current noise cannot be obtained by such composition.

Accordingly, it is an object of this invention to provide a glaze resistor which can have stable resistivity over a wide resistivity range and which has a small temperature coefficient of resistivity and produces only low current noise.

This object is achieved according to this invention by providing a glaze resistor composition consisting essentially of 7 to 50 weight percent of a silicide component and 93 to 50 weight percent of a glass frit, the silicide component comprising magnesium silicide, molybdenum disilicide and tantalum disilicide, wherein the molar ratio of the sum of molybdenum disilicide and tantalum disilicide to magnesium silicide is from 30/70 to 90/10, and the molar ratio of molybdenum disilicide to tantalum disilicide is from 90/10 to 70/30.

According to a further development of this invention, the temperature coefficient of the glaze resistor is shifted to positive side by adding manganese disilicide to the starting material. According to a still further development of this invention, the resistivity of the glaze resistor is increased and further stabilized by adding aluminum oxide to the glaze resistor composition. According to a yet further development of this invention, the effect of the aluminum oxide addition is enhanced by a method employing two heating steps and by adding aluminum oxide to starting mixture of silicides and glass frit before the first heating step.

This invention will be described in detail with the aid of the accompanying drawings, in which.

Figure 1:
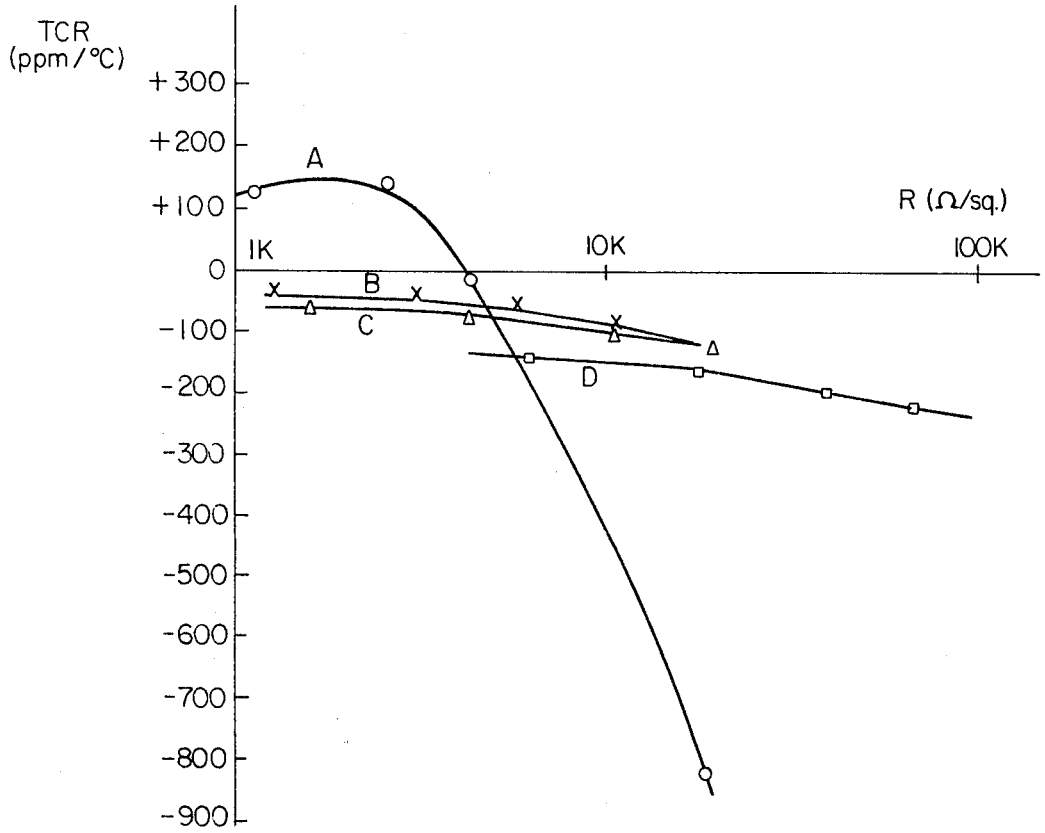
FIG. 1 is a graph showing the relation between the resistivities and the temperature coefficients of resistivity of each of four types of glaze resistors.

Hereinafter, preferred embodiments of glaze resistor compositions and of the methods of making glaze resistors according to this invention will be described.

According to this invention, magnesium disilicide is added to the known combination of molybdenum disilicide and tantalum disilicide. The addition of magnesium silicide functions to stabilize the resultant resistivity of glaze resistor in a wide resistivity range, and to improve the characteristics of current noises, temperature coefficients of resistivity and stability to load tests. It is presumed that magnesium silicide plays the role of a conductor as well as a reducing reagent upon the heating of a glaze resistor paste. A preferred molar ratio of the sum of molybdenum disilicide and tantalum disilicide to magnesium disilicide is from 30/70 to 90/10, more preferably from 60/40 to 80/20. Too large an amount of magnesium silicide is undesired in view of the stability of resultant glaze resistors to humidity. Too small an amount of magnesium silicide is not effective for the intended function thereof. A preferable molar ratio of molybdenum disilicide to tantalum disilicide is from 90/10 to 70/30, more preferably from 80/20 to 70/30. Too small an amount of tantalum disilicide causes bubbles in the resultant glaze resistor films. Too small an amount of molybdenum disilicide is undesired in view of the resultant characteristics of current noises, load test and temperature coefficients of resistivity.

This silicide component, which comprises magnesium silicide, molybdenum disilicide and tantalum disilicide, is mixed with a glass frit in an amount such that its mixture consists essentially of 7 to 50 weight percent of the silicide component and 93 to 50 weight percent of the glass frit. By varying the weight percentages thereof in the above range, the resultant glaze resistors can be varied in a wide resistivity range without causing problems with respect to the stability of resistivity, current noise and temperature coefficients of resistivity. As the amount of the glass frit increases, the resistivity becomes higher. The existence of magnesium silicide is particularly important in the case of glass frit-rich compositions, i.e. high resistivity range. Any suitable glass can be used for the glass frit. A preferred glass therefor is a barium borate glass. For example, a glass consisting essentially of 25 to 55 weight percent of BaO, 30 to 60 weight percent of $B_2O_3$, 0 to 10 weight percent of $SiO_2$, 0 to 16 weight percent of $Al_2O_3$, 0to 5 weight percent of CaO and 0 8 weight percent percent of MgO can be used therefor.

The above silicide component can further contain 1 to 50 molar percent of manganese disilicide. The effect of the manganese disilicide addition is to shift the temperature coefficient of resistivity to the positive side. Too small an amount of manganese disilicide is not effective for the intended effect, but too large an amount of manganese disilicide is undesired in view of the resultant current noises and load test characteristics, i.e. change of resistivity after load tests.

An example of the method of making a glaze resistor using the above glaze resistor compositions will be described below. In the first place, a starting powder mixture of a silicide component is prepared. For obtaining good characteristics of the resultant glaze resistors, the particle size of the silicides is preferably small. For example, the average particle size is selected from the range of 0.05 to 0.8 micron, more preferably from the range of 0.1 to 0.3 micron. This powder mixture of the silicide component is mixed with an appropriate amount of a glass frit having an average particle size usually between 1 to 10 microns, and also with a suitable organic liquid vehicle to form a glaze resistor paste. The liquid vehicle can be composed, for example, of terpineol having 10% ethylcellulose dissolved therein. The thus made glaze resistor paste is applied on a suitable refractory substrate such as a ceramic plate, and is then heated or fired in air in, for example, a tunnel furnace. The temperature for this heating is so selected that the glass frit is adequately fused both in itself and onto the refractory substrate. Usually, the heating temperature is between 750° and 1000° C, more preferably between 800° and 900° C, and the heating time is between 3 and 30 minutes. Thereby, a glaze resistor in film form is made. During the heat treatment, the liquid vehicle evaporates or burns off, and does not substantially affect the resistivity or other characteristics of the resultant glaze resistor.

According to a further development of this invention, the resistivity and the stability of the resistivity of the resultant glaze resistor is increased by adding aluminum oxide ($Al_2O_3$) to the starting powder mixture. The effect of the addition of the aluminum oxide is remarkable when the glaze resistor is made by a two-step heating method, in which aluminum oxide is added to the starting powder mixture before the first heating step. One example of the two-step heating method will be described below.

In the first place, a starting powder mixture of a silicide component, aluminum oxide and a glass frit is prepared. This glass frit can be called a first glass frit since a further glass frit is used in the last heating step, which further glass frit can be called a second glass frit. The weight ratio of the silicide component to the sum of the aluminum oxide and the first glass frit is preferably from 30/70 to 70/30, more preferably from 55/45 to 65/35. If the amount of the silicide component is too small, the resultant glaze resistor has undesired characteristics, particularly in the high resistivity range, as e.g. to the current noise, temperature coefficients of resistivity and stability of resistivity to load tests. If the amount of aluminum oxide and the first glass frit is too small, aluminum oxide does not exhibit its effect or the first glass frit does not satisfactorily function as a binder.

The weight ratio of aluminum oxide to the first glass frit is preferably from 1/2 to 5/1, more preferably from 1.5/1 to 2.5/1. If the amount of aluminum oxide is too small, it does not exhibit its effect. If the amount of the first glass frit is too small, it does not satisfactorily function as a binder. Further, too large amount of aluminum oxide is undesirable in view of the reproducibility of resistivities. The particle size of aluminum oxide is also preferably fine, e.g. in a range between 0.1 and 1 micron. The silicide component in this two-step heating method also comprises magnesium silicide, molybdenum disilicide and tantalum disilicide in a molar ratio the same as that in the above described embodiment, which does not employ the aluminum oxide addition. The silicide component can contain manganese disilicide just as in the case of the above described embodiment. The silicide component powder is preferably fine, and the first glass frit is preferably made of a barium borate glass just as in the case of the above described embodiment.

The thus prepared mixture of the silicide component, aluminum oxide and the first glass frit is compressed into a compressed body by a usual pressure e.g. between 300 and 2000 kg/cm$^2$. This compressed body is then heated at a temperature preferably between 700° and 1300° C, more preferably between 1050° and 1150° C, for a time period preferably between 30 minutes and 5 hours in an atmosphere which is preferably non-oxidizing and non-reducing such as vacuum and an inert gas. This heating step can be called a first heating step in the two-step heating method. In the thus heated body, the first glass frit becomes molten and is believed to coat the silicide component and aluminum oxide for protecting the silicide component from oxidization thereof which otherwise might occur by the second heating step carried out in air.

The thus heated body is cooled and ground into fine granules, e.g. between 0.5 and 5 microns. The thus made granules are mixed with a second glass frit in an amount such that the silicide component is in the range from 7 to 30 weight percent, and the sum of the aluminum oxide and the first and second glass frits is in the range from 93 to 70 weight percent on the basis of the sum of the silicide component, aluminum oxide and the first and second glass frits. The amount of the second glass frit is selected in view of the desired resistivity of the resultant glaze resistor. The second glass frit has an average particle size preferably between 1 and 10 microns, and can be made of the same glass as that of the first glass frit. If the current noise and load test characteristics of the resultant glaze resistor are desired to be further improved, niobium oxide can be used as an additive in the second glass frit. Thus, for example, a glass consisting essentially of 25 to 55 weight percent of BaO, 30 to 60 weight percent of $B_2O_3$, 0 to 10 weight percent of $SiO_2$, 0 to 16 weight percent of $Al_2O_3$, 0 to 5 weight percent of CaO, 0 to 8 weight percent of MgO and 0 to 7 weight percent of $Nb_2O_5$ can be used for the second glass frit.

The thus made mixture of the granules and the second glass frit is mixed with a suitable liquid vehicle such as terpineol having 5% ethylcellulose dissolved therein to form a glaze resistor paste. This glaze resistor paste is applied on a suitable refractory substrate, and is then heated in air just as in the case of the above embodiment which uses a single heating step. Thereby, a glaze resistor in a film form is made.

This invention will more readily be understood with reference to the following specific Examples I and II, but these Examples are intended to only illustrate this invention, and are not to be construed to limit the scope of this invention.

EXAMPLE I

By varying the amounts of magnesium silicide, molybdenum disilicide, tantalum disilicide, manganese disilicide and glass frit, 72 different glaze resistor compositions (Sample Nos. 1 to 72) were prepared as apparent from Table I. More specifically, silicide component powder mixtures of magnesium silicide, molybdenum disilicide and tantalum disilicide with or without manganese disilicide in molar percentages as listed in Table I were prepared. Each powder mixture had an average particle size of 0.2 micron. The silicide powder mixtures were each mixed with a glass frit in the weight percentage as listed in Table I on the basis that the sum of the silicide component and the glass frit in each sample was 100 weight percent. The glass frit had an average particle size of 5 microns, and was composed of a barium borate glass consisting of 38.4 weight percent of barium oxide, 42.1 weight percent of boron oxide, 4.9 weight percent of silicon oxide, 8.7 weight percent of aluminum oxide, 2.1 weight percent of calcium oxide and 3.8 weight percent of magnesium oxide.

Each mixture of the silicide component and the glass frit was well dispersed in an appropriate amount of terpineol having 10% ethylcellulose dissolved therein to make a paste ready for screen printing. Each of the thus made pastes was applied on a ceramic substrate by screen printing, and was dried. Each of the ceramic substrates thus having a printed paste layer was heated in air at a temperature of 850° C for 10 minutes.

Thereby, 72 glaze resistors, each in the form of a film were obtained. Each of the thus made glaze resistors was subjected to measurement of sheet resistivity R (Ω/sq.), temperature coefficient of resistivity TCR (ppm/° C), current noise (dB) and load test characteristics (percent change of resistivity after a load test). The load test was carried out by applying an electric power of 625 mW/mm$^2$ to the glaze resistor for 5 seconds at room temperature. The load test characteristic is represented by the difference between the resistivities of the glaze resistor before and after the load test, on the basis of the resistivity thereof before the load test. The results of the measurements are shown in Table I.

It is apparent from Table I that various resistivities in wide resistivity range with small temperature coefficients of resistivity, low current noises and good load test characteristics can be obtained by this invention. As the amount of magnesium silicide increases, the resistivity becomes higher, and the temperature coefficient of resistivity tends to increase. However, all the values of the temperature coefficients of resistivity fall within the range not higher than 200 ppm/° C, except for the case of very low resistivities. As to the load test characteristics, they are fairly good, particularly in the lower resistivity range.

EXAMPLE II

By varying the amounts of magnesium silicide, molybdenum disilicide, tantalum disilicide, aluminum oxide, the first and second glass frits and the heating temperature for the first heating step in the case of the two-step heating method, 30 different glaze resistor compositions (Sample Nos. 73 to 102) were prepared as apparent from Table II. More specifically, silicide component powder mixtures of magnesium silicide, molybdenum disilicide and tantalum disilicide in molar percentages as listed in Table II were prepared. Each powder mixture had an average particle size of 0.2 micron. Each of the silicide powder mixture was mixed with aluminum oxide powder and a first glass frit in the weight percentage as listed in Table II. The aluminum oxide powder had an average particle size of 0.3 microns. The first glass frit was the same as the glass frit used in Example I.

Each mixture of the silicide component, the aluminum oxide powder and the first glass frit was compressed under a pressure of 750 kg/cm$^2$ to a compressed body. The thus made bodies were heated in vacuum at temperatures as shown in Table II (first heating step), and were then cooled. Each of the cooled bodies was ground to granules having an average particle size of 0.5 micron. The granules were then mixed with a second glass frit in the weight percentage as listed in Table II on the basis that the sum of the granules and the second glass frit was 100 weight percent. The second glass frit had an average particle size of 5 microns, and was composed of a barium borate glass consisting of 37.9 weight percent of barium oxide, 41.5 weight percent of boron oxide, 4.8 weight percent of silicon oxide, 8.6 weight percent of aluminum oxide, 2.1 weight percent of calcium oxide, 3.8 weight percent of magnesium oxide and 1.3 weight percent of niobium oxide.

Each mixture of the granules and the second glass frit was well dispersed in an appropriate amount of terpineol having 5% ethylcellulose dispersed therein to make a paste ready for screen printing. Each of the thus made pastes was applied on a ceramic substrate by screen printing, and was dried. Each of the ceramic substrates thus having a printed paste layer was heated in air at a temperature of 850° C for 10 minutes (second heating step). Thereby, 30 glaze resistors, each in the form of a film were obtained. Each of the thus made glaze resistors was subjected to the measurements of sheet resistivity, temperature coefficient of resistivity, current noise and load test characteristics just as in Example I. The results of the measurements are shown in Table II. It is apparent from Table II that various resistivities in a wide resistivity range, particularly up to a very high resistivity, with small temperature coefficients of resistivity, low current noises and good load test characteristics can be obtained by this invention. Although the temperature coefficients of resistivity tends to slightly shift to negative side according to the method of Example II, the amount of the shfit practically does not cause any problem. If the temperature coefficient values are desired to be shited to the positive side, it can be done by adding manganese disilicide to the sillicide component as in Example I.

Figure 2:
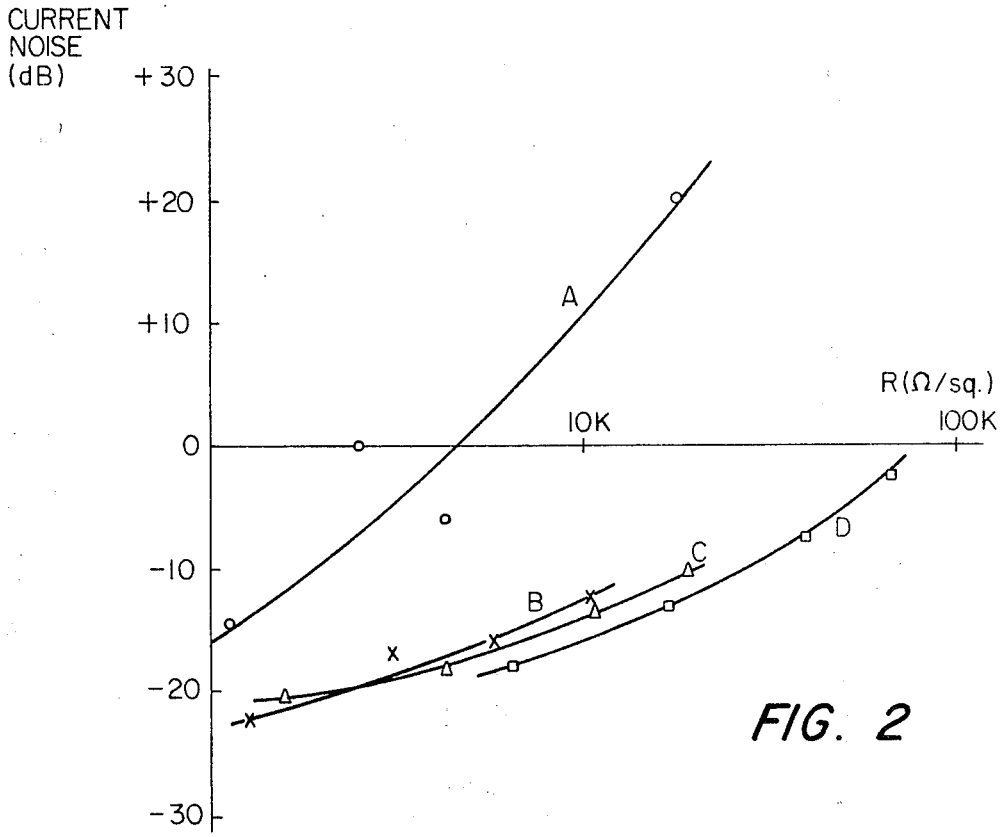
FIG. 2 is a graph showing the relation between the resistivities and the current noises of each of the four types of glaze resistors.
Figure 3:
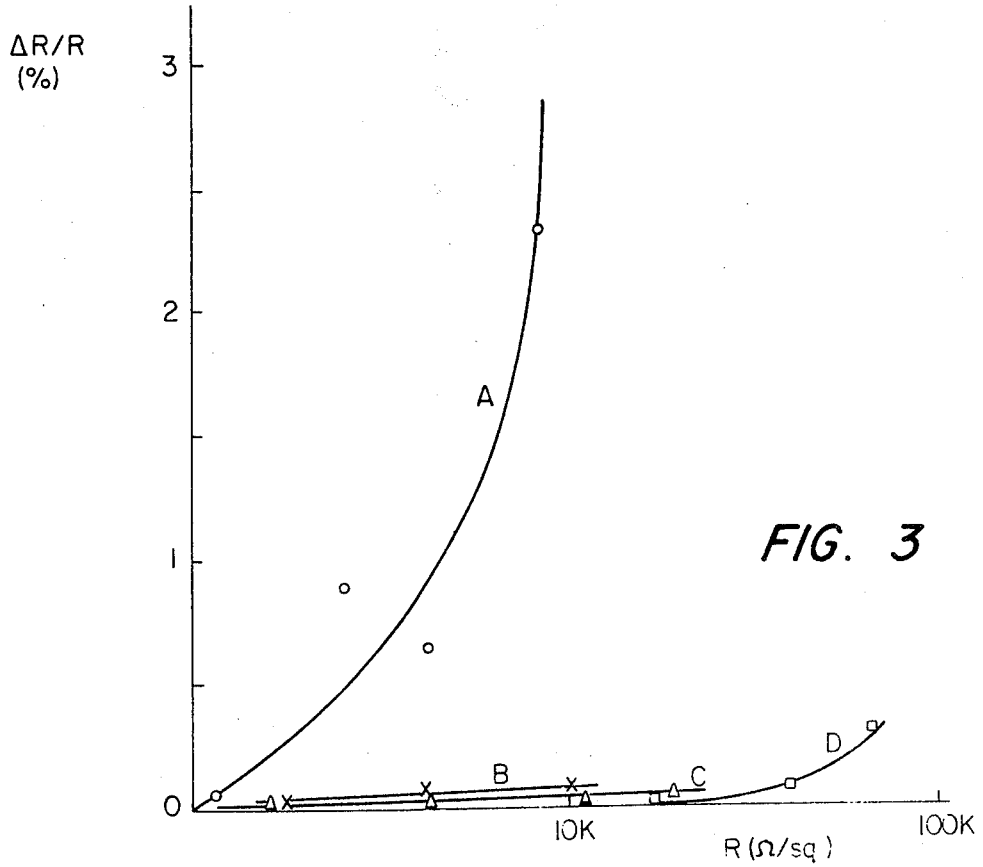
FIG. 3 is a graph showing the relation between the resistivities and the changes of resistivities of the four types of glaze resistors after a load test.

The effect of the use of magnesium silicide may more readily be understood with reference to FIGS. 1 to 3. The samples represented by the curves in these Figures were made in a manner described in Example II. The samples of curves A to D had silicide components of $MO_{0.7125}Ta_{0.2375}Mg_{0.05}Si_{1.925}$, $Mo_{0.675}Ta_{0.225}Mg_{0.1}Si_{1.85}$, $Mo_{0.6}Ta_{0.2}Mg_{0.2}Si_{1.7}$ and $M_{0.4875}Ta_{0.1625}Mg_{0.35}Si_{1.48}$, respectively. 60 weight percent of each of all these silicide components was mixed with 25 weight percent of aluminum oxide and 15 weight percent of the first glass frit to make the granules to be subjected to the first heating step. The first heating step was carried out at a temperature of 1100° C for 2 hours. By varying the amount of the granules relative to the second glass frit, various glaze resistors having various resistivities for each of the curves A to D were obtained. The significance of the use of magnesium silicide in an appropriate amount is apparent from FIGS. 1 to 3.

When aluminum oxide is used as in Example II, the glaze resistor composition preferably has a composition of 7 to 30 weight percent of a silicide component and 93 to 70 weight percent, in total, of aluminum oxide and a glass frit which is the sum of the first and second glass frits. The molar ratio of the sum of molybdenum disilicide and tantalum disilicide to magnesium silicide is preferably from 30/70 to 90/10, and the molar ratio of molybdenum disilicide to tantalum disilicide is preferably from 90/10 to 70/30, just as in the embodiment corresponding to Example I. The weight ratio of the silicide component to aluminum oxide is preferably from 30/58.5 to 70/10. Further, the silicide component can contain 1 to 50 molar percent of manganese disilicide.

While particular embodiments of this invention have been shown and described, it will be obvious to those skilled in the art that changes and modifications may be made without departing from this invention in its broader aspects and, therefore, the aim of the appended claims is to cover all such changes and modifications as fall within the true spirit and scope of this invention.

Table I

| Sample No. | Silicide component (molar %) $Mg_2Si$ | $MoSi_2$ | $TaSi_2$ | $MnSi_2$ | glass frit / glass frit+silicides (weight %) | R (Ω/sq.) | TCR (ppm/° C) | Current noise (db) | Load test ΔR/R (%) |
|---|---|---|---|---|---|---|---|---|---|
| 1 | 10 | 81 | 9 | — | 93 | $3.0^k$ | + 50 | −15 | 0.1 |
| 2 | 10 | 81 | 9 | — | 90 | 700 | + 80 | −23 | 0 |
| 3 | 10 | 81 | 9 | — | 80 | 120 | +160 | −25 | 0 |
| 4 | 10 | 81 | 9 | — | 50 | 15 | +300 | −26 | 0 |
| 5 | 10 | 72 | 18 | — | 93 | $3.2^k$ | + 45 | −14 | 0.15 |
| 6 | 10 | 72 | 18 | — | 90 | 950 | + 60 | −22 | 0 |
| 7 | 10 | 72 | 18 | — | 80 | 160 | +130 | −26 | 0 |
| 8 | 10 | 72 | 18 | — | 50 | 17 | +280 | −26 | 0 |
| 9 | 10 | 63 | 27 | — | 93 | $6.5^k$ | + 25 | −10 | 0.15 |
| 10 | 10 | 63 | 27 | — | 90 | $2.0^k$ | + 35 | −14 | 0 |
| 11 | 10 | 63 | 27 | — | 80 | 250 | +100 | −22 | 0 |
| 12 | 10 | 63 | 27 | — | 50 | 23 | +200 | −24 | 0 |
| 13 | 20 | 72 | 8 | — | 93 | $3.8^k$ | + 45 | −15 | 0.12 |
| 14 | 20 | 72 | 8 | — | 90 | $1.2^k$ | + 60 | −20 | 0 |
| 15 | 20 | 72 | 8 | — | 80 | 200 | + 95 | −25 | 0 |
| 16 | 20 | 72 | 8 | — | 50 | 18 | +165 | −25 | 0 |
| 17 | 20 | 64 | 16 | — | 93 | $4.1^k$ | + 20 | −14 | 0.10 |
| 18 | 20 | 64 | 16 | — | 90 | $1.7^k$ | + 35 | −18 | 0 |
| 19 | 20 | 64 | 16 | — | 80 | 220 | + 80 | −26 | 0 |
| 20 | 20 | 64 | 16 | — | 50 | 20 | +150 | −27 | 0 |
| 21 | 20 | 56 | 24 | — | 93 | $16.0^k$ | − 10 | − 6 | 0.21 |
| 22 | 20 | 56 | 24 | — | 90 | $5.1^k$ | 0 | −15 | 0.08 |
| 23 | 20 | 56 | 24 | — | 80 | 480 | + 15 | −25 | 0 |
| 24 | 20 | 56 | 24 | — | 50 | 34 | + 50 | −26 | 0 |
| 25 | 35 | 58.5 | 6.5 | — | 93 | $8.8^k$ | + 12 | −10 | 0.10 |
| 26 | 35 | 58.5 | 6.5 | — | 90 | $3.5^k$ | + 18 | −17 | 0.02 |
| 27 | 35 | 58.5 | 6.5 | — | 80 | 360 | + 30 | −26 | 0 |
| 28 | 35 | 58.5 | 6.5 | — | 50 | 28 | +120 | −26 | 0 |
| 29 | 35 | 52 | 13 | — | 93 | $16.0^k$ | − 12 | − 6 | 0.20 |
| 30 | 35 | 52 | 13 | — | 90 | $5.9^k$ | − 5 | −16 | 0.03 |
| 31 | 35 | 52 | 13 | — | 80 | 490 | + 20 | −25 | 0 |
| 32 | 35 | 52 | 13 | — | 50 | 35 | +120 | −25 | 0 |
| 33 | 35 | 45.5 | 19.5 | — | 93 | $24^k$ | − 35 | − 2 | 0.30 |
| 34 | 35 | 45.5 | 19.5 | — | 90 | $7.1^k$ | − 11 | −12 | 0.08 |
| 35 | 35 | 45.5 | 19.5 | — | 80 | 610 | + 7 | −24 | 0 |
| 36 | 35 | 45.5 | 19.5 | — | 50 | 40 | + 95 | −26 | 0 |
| 37 | 50 | 45 | 5 | — | 93 | $25^k$ | − 55 | + 3 | 0.45 |
| 38 | 50 | 45 | 5 | — | 90 | $7.5^k$ | − 12 | −11 | 0.10 |
| 39 | 50 | 45 | 5 | — | 80 | 520 | + 5 | −25 | 0 |
| 40 | 50 | 45 | 5 | — | 50 | 38 | + 80 | −26 | 0 |
| 41 | 50 | 40 | 10 | — | 93 | $18.5^k$ | − 50 | − 3 | 0.23 |
| 42 | 50 | 40 | 10 | — | 90 | $6.4^k$ | − 12 | −13 | 0.08 |
| 43 | 50 | 40 | 10 | — | 80 | 510 | + 3 | −23 | 0 |
| 44 | 50 | 40 | 10 | — | 50 | 36 | + 75 | −26 | 0 |
| 45 | 50 | 35 | 15 | — | 93 | $33^k$ | − 70 | + 7 | 1.10 |
| 46 | 50 | 35 | 15 | — | 90 | $10^k$ | − 15 | − 9 | 0.50 |
| 47 | 50 | 35 | 15 | — | 80 | 640 | + 5 | −20 | 0 |
| 48 | 50 | 35 | 15 | — | 50 | 40 | + 72 | −25 | 0 |
| 49 | 70 | 27 | 3 | — | 93 | $41^k$ | − 50 | +10 | 2.1 |
| 50 | 70 | 27 | 3 | — | 90 | $15^k$ | − 15 | − 6 | 0.80 |
| 51 | 70 | 27 | 3 | — | 80 | 900 | − 10 | −11 | 0 |
| 52 | 70 | 27 | 3 | — | 50 | 42 | + 60 | −25 | 0 |
| 53 | 70 | 24 | 6 | — | 93 | $51^k$ | − 75 | +13 | 3.0 |
| 54 | 70 | 24 | 6 | — | 90 | $17^k$ | − 20 | − 2 | 0.32 |
| 55 | 70 | 24 | 6 | — | 80 | 930 | − 15 | − 7 | 0 |
| 56 | 70 | 24 | 6 | — | 50 | 51 | + 55 | −25 | 0 |
| 57 | 70 | 21 | 9 | — | 93 | $71^k$ | −120 | +19 | 5.5 |
| 58 | 70 | 21 | 9 | — | 90 | $20^k$ | − 30 | + 2 | 0.50 |
| 59 | 70 | 21 | 9 | — | 80 | $1.0^k$ | − 20 | − 7 | 0 |
| 60 | 70 | 21 | 9 | — | 50 | 55 | + 43 | −26 | 0 |
| 61 | 35 | 52 | 13 | 1 | 93 | $18.5^k$ | − 5 | −12 | 0.3 |
| 62 | 35 | 52 | 13 | 1 | 90 | $7.0^k$ | + 3 | − 4 | 0.05 |
| 63 | 35 | 52 | 13 | 1 | 80 | 650 | + 25 | −24 | 0 |
| 64 | 35 | 52 | 13 | 1 | 50 | 40 | +155 | −25 | 0 |
| 65 | 29.2 | 43.3 | 10.8 | 20 | 93 | $41^k$ | +190 | + 8 | 1.3 |
| 66 | 29.2 | 43.3 | 10.8 | 20 | 90 | $11.5^k$ | +210 | − 8 | 0.2 |
| 67 | 29.2 | 43.3 | 10.8 | 20 | 80 | 750 | +290 | −12 | 0 |
| 68 | 29.2 | 43.3 | 10.8 | 20 | 50 | 53 | +400 | −26 | 0 |
| 69 | 23.3 | 34.7 | 8.7 | 50 | 93 | $91^k$ | +360 | +15 | 6.2 |
| 70 | 23.3 | 34.7 | 8.7 | 50 | 90 | $16.0^k$ | +400 | − 4 | 0.25 |
| 71 | 23.3 | 34.7 | 8.7 | 50 | 80 | $1.2^k$ | +470 | −10 | 0 |
| 72 | 23.3 | 34.7 | 8.7 | 50 | 50 | 650 | +490 | −16 | 0 |

Table II

| Sample No. | Silicide component (molar %) $Mg_2Si$ | $MoSi_2$ | $TaSi_2$ | Granule component (weight %) silicide component | $Al_2O_3$ | 1st glass frit | 1st heating temp. (° C) | 2nd glass frit / (2nd glass frit+granule) (weight %) | R (Ω/sq.) | TCR (ppm/° C) | Current noise (dB) | Load test ΔR/R (%) |
|---|---|---|---|---|---|---|---|---|---|---|---|---|
| 73 | 10.0 | 67.5 | 22.5 | 70 | 15 | 15 | 1100 | 90 | $36^k$ | −140 | − 4 | 0.1 |
| 74 | 10.0 | 67.5 | 22.5 | 70 | 15 | 15 | 1100 | 86 | $11^k$ | − 90 | −14 | 0 |
| 75 | 10.0 | 67.5 | 22.5 | 70 | 15 | 15 | 1100 | 79 | $2.1^k$ | − 40 | −21 | 0 |
| 76 | 10.0 | 67.5 | 22.5 | 70 | 15 | 15 | 1100 | 71 | $1.3^k$ | − 30 | −22 | 0 |
| 77 | 10.0 | 67.5 | 22.5 | 70 | 15 | 15 | 1100 | 57 | 400 | − 20 | −28 | 0 |
| 78 | 20 | 56 | 24 | 60 | 25 | 15 | 1200 | 88 | $1^M$ | −700 | +20 | 3.1 |
| 79 | 20 | 56 | 24 | 60 | 25 | 15 | 1200 | 83 | $500^k$ | −650 | +15 | 1.5 |
| 80 | 20 | 56 | 24 | 60 | 25 | 15 | 1200 | 75 | $210^k$ | −480 | + 8 | 0.4 |

Table II-continued

| Sample No. | Silicide component (molar %) $Mg_2Si$ | $MoSi_2$ | $TaSi_2$ | Granule component (weight %) silicide component | $Al_2O_3$ | 1st glass frit | 1st heating temp. (° C) | 2nd glass frit (2nd glass frit+ granule) (weight %) | R (Ω/sq.) | TCR (ppm/° C) | Current noise (dB) | Load test ΔR/R (%) |
|---|---|---|---|---|---|---|---|---|---|---|---|---|
| 81 | 20 | 56 | 24 | 60 | 25 | 15 | 1200 | 67 | $60^k$ | −300 | −10 | 0 |
| 82 | 20 | 56 | 24 | 60 | 25 | 15 | 1200 | 50 | $10^k$ | −200 | −15 | 0 |
| 83 | 20 | 56 | 24 | 30 | 23 | 47 | 700 | 77 | $19.0^k$ | − 12 | − 8 | 0 |
| 84 | 20 | 56 | 24 | 30 | 23 | 47 | 700 | 67 | $7.5^k$ | − 3 | −14 | 0 |
| 85 | 20 | 56 | 24 | 30 | 23 | 47 | 700 | 50 | 620 | + 11 | −23 | 0 |
| 86 | 20 | 56 | 24 | 30 | 23 | 47 | 700 | 33 | 70 | + 40 | −25 | 0 |
| 87 | 20 | 56 | 24 | 30 | 23 | 47 | 700 | 5 | 50 | + 50 | −26 | 0 |
| 88 | 20 | 56 | 24 | 30 | 58.5 | 11.5 | 1300 | 77 | $5^M$ | −1000 | — | 4.1 |
| 89 | 20 | 56 | 24 | 30 | 58.5 | 11.5 | 1300 | 67 | $2.3^M$ | −780 | — | 3.3 |
| 90 | 20 | 56 | 24 | 30 | 58.5 | 11.5 | 1300 | 50 | $820^k$ | −680 | +20 | 1.0 |
| 91 | 20 | 56 | 24 | 30 | 58.5 | 11.5 | 1300 | 33 | $300^k$ | −400 | +10 | 0.5 |
| 92 | 20 | 56 | 24 | 30 | 58.5 | 11.5 | 1300 | 5 | $100^k$ | −250 | + 7 | 0.2 |
| 93 | 35 | 52 | 13 | 70 | 10 | 20 | 1100 | 90 | $20^k$ | − 10 | −10 | 0 |
| 94 | 35 | 52 | 13 | 70 | 10 | 20 | 1100 | 86 | $11^k$ | − 7 | −13 | 0 |
| 95 | 35 | 52 | 13 | 70 | 10 | 20 | 1100 | 79 | 800 | 0 | −22 | 0 |
| 96 | 35 | 52 | 13 | 70 | 10 | 20 | 1100 | 71 | 120 | + 30 | −24 | 0 |
| 97 | 35 | 52 | 13 | 70 | 10 | 20 | 1100 | 57 | 70 | + 50 | −27 | 0 |
| 98 | 40 | 54 | 6 | 70 | 25 | 5 | 1100 | 90 | $90^k$ | −200 | − 4 | 0.8 |
| 99 | 40 | 54 | 6 | 70 | 25 | 5 | 1100 | 86 | $42^k$ | −140 | − 6 | 0.2 |
| 100 | 40 | 54 | 6 | 70 | 25 | 5 | 1100 | 79 | $25^k$ | −120 | − 6 | 0.12 |
| 101 | 40 | 54 | 6 | 70 | 25 | 5 | 1100 | 71 | $12^{ks}$ | −100 | − 7 | 0.1 |
| 102 | 40 | 54 | 6 | 70 | 25 | 5 | 1100 | 57 | $2^k$ | − 50 | −20 | 0 |

What is claimed is:

1. A glaze resistor composition consisting essentially of 7 to 50 weight percent of a silicide component and 93 to 50 weight percent of a glass frit, said silicide component consisting essentially of magnesium silicide, molybdenum disilicide and tantalum disilicide, wherein the molar ratio of the sum of molybdenum disilicide and tantalum disilicide to magnesium silicide is from 30/70 to 90/10, and the molar ratio of molybdeum disilicide to tantalum disilicide is from 90/10 to 70/30.

2. A glaze resistor composition according to claim 1, wherein said molar ratio of the sum of molybdenum disilicide and tantalum disilicide to magnesium silicide is from 60/40 to 80/20.

3. A glass resistor composition according to claim 1, wherein said molar ratio of molybdenum disilicide to tantalum disilicide is from 80/20 to 70/30.

4. A glaze resistor composition according to claim 1, wherein said silicide component further contains 1 to 50 molar percent of manganese disilicide.

5. A glaze resistor composition according to claim 1, wherein said glass frit is of a barium borate glass.

6. A glaze resistor composition consisting essentially of 7 to 30 weight percent of a silicide component and 93 to 70 weight percent, in total, of aluminum oxide and a glass frit, said silicide component consisting essentially of magnesium silicide, molybdenum disilicide and tantalum disilicide, wherein the molar ratio of the sum of molybdenum disilicide and tantalum disilicide to magnesium silicide is from 30/70 to 90/10, the molar ratio of molybdenum disilicide to tantalum disilicide is from 90/10 to 70/30, and the weight ratio of said silicide component to aluminum oxide is from 30/58.5 to 70/10.

7. A glaze resistor composition according to claim 6, wherein said molar ratio of the sum of molybdenum disilicide and tantalum disilicide to magnesium silicide is from 60/40 to 80/20.

8. A glaze resistor composition according to claim 6, wherein said molar ratio of molybdenum disilicide to tantalum disilicide is from 80/20 to 70/30.

9. A glaze resistor composition according to claim 6, wherein said silicide component further contains 1 to 50 molar percent of manganese disilicide.

10. A glaze resistor composition according to claim 6, wherein said glass frit is of a barium borate glass.

11. A method of making a glaze resistor, comprising the steps of: preparing a starting powder mixture of a silicide component, aluminum oxide and a first glass frit, the weight ratio of said silicide component to the sum of aluminum oxide and said first glass frit being from 30/70 to 70/30, the weight ratio of aluminum oxide to said first glass frit being from 1/2 to 5/1, and said silicide component consisting essentially of magnesium silicide, molybdenum disilicide and tantalum disilicide, wherein the molar ratio of the sum of molybdenum disilicide and tantalum disilicide to magnesium silicide is from 30/70 to 90/10, and the molar ratio of molybdenum disilicide to tantalum disilicide is from 90/10 to 70/30; compressing said starting powder mixture into a compressed body; first heating said compressed body at a temperature between 700° C and 1300° C; grinding the thus heated body into granules; mixing said granules with a second glass frit in an amount such that said silicide component is in a range from 7 to 30 weight percent, and the sum of said aluminum oxide and first and second glass frits is in the range from 93 to 70 weight percent on the basis of the sum of said silicide component, aluminum oxide, and first and second glass frits; and second heating the thus prepared mixture at a temperature between 750° C and 1000° C.

12. A method according to claim 11, wherein said weight ratio of said silicide component to the sum of said aluminum oxide and said first glass frit is from 55/45 to 65/35.

13. A method according to claim 11, wherein said molar ratio of the sum of molybdenum silicide and tantalum disilicide to magnesium silicide is from 60/40 to 80/20.

14. A method according to claim 11, wherein said molar ratio of molybdenum disilicide to tantalum disilicide is from 80/20 to 70/30.

15. A method according to claim 11, wherein said silicide component further contains 1 to 50 molar percent of manganese disilicide.

16. A method according to claim 11, wherein each of said first and second glass frits is a barium borate glass.

17. A method according to claim 11, wherein the temperature of said first heating is between 1050° and 1150° C.

18. A method according to claim 11, wherein the temperature of said second heating is between 800° C and 900° C.

* * * * *